US007454145B2

(12) United States Patent
Weaver et al.

(10) Patent No.: US 7,454,145 B2
(45) Date of Patent: Nov. 18, 2008

(54) PACKAGING DETECTION AND REMOVAL FOR AN IMAGE FORMING DEVICE

(75) Inventors: Brian P. Weaver, Shelbyville, KY (US); William Paul Cook, Lexington, KY (US)

(73) Assignee: Lexmark International, Inc, Lexington, KY (US)

( * ) Notice: Subject to any disclaimer, the term of this patent is extended or adjusted under 35 U.S.C. 154(b) by 80 days.

(21) Appl. No.: 11/225,482

(22) Filed: Sep. 13, 2005

(65) Prior Publication Data

US 2007/0058990 A1 Mar. 15, 2007

(51) Int. Cl.
*G03G 15/00* (2006.01)

(52) U.S. Cl. ..... 399/9; 399/119; 399/122

(58) Field of Classification Search ..... 399/9, 399/20, 107, 119, 122
See application file for complete search history.

(56) References Cited

U.S. PATENT DOCUMENTS 4,176,941 A 12/1979 Breitenkam et al.
4,320,953 A 3/1982 Schultes et al.
4,360,279 A 11/1982 Sugiura
4,411,511 A 10/1983 Ariyama et al.
4,566,684 A 1/1986 Gysling
4,577,849 A 3/1986 Watanabe
4,580,917 A 4/1986 Hibino
4,589,765 A 5/1986 Perun et al.
4,627,711 A 12/1986 Schron
4,660,821 A 4/1987 Boser et al.
4,682,158 A 7/1987 Ito et al.
4,682,769 A 7/1987 Murakami et al.
4,744,687 A 5/1988 Nukaya et al.
4,766,463 A 8/1988 Watanuki et al.
4,790,524 A 12/1988 Murakami et al.
4,809,969 A 3/1989 Bastow et al.
4,868,609 A 9/1989 Nagata et al.
4,884,796 A 12/1989 Daboub
4,900,003 A 2/1990 Hashimoto
4,908,655 A 3/1990 Takagi
4,919,318 A 4/1990 Wong
4,982,230 A * 1/1991 Ogura et al. ..... 399/35
4,990,011 A 2/1991 Underwood et al.
4,996,557 A 2/1991 Takagi
5,034,780 A 7/1991 Kotabe et al.
5,056,771 A 10/1991 Beck et al.
5,121,914 A 6/1992 Hargreaves
5,121,915 A 6/1992 Duncan et al.
5,141,217 A 8/1992 Lim et al.
5,164,770 A 11/1992 Furuichi et al.
5,171,977 A 12/1992 Morrison (Continued)

*Primary Examiner*—Quana M Grainger

(57) ABSTRACT

Upon initialization of an image-forming device, a sensor generates a signal to indicate the presence of packaging material at a location within the image-forming device. The image-forming device displays a message to a user responsive to this signal. The message may include a graphical representation of the image-forming device that graphically indicates access to the location. Upon user request, the image-forming device may also display instructions on how to remove the packaging material from the location. The instructions may also include a graphical representation of the location within the image-forming device, and text describing how to remove the packaging material from the location. The sensor generates another signal when it senses that the packaging material has been removed from the location. Once the packaging materials have been removed, the image-forming device completes the initialization procedure in preparation for image-forming operations.

19 Claims, 6 Drawing Sheets

U.S. PATENT DOCUMENTS 5,182,597 A 1/1993 Masuda et al.
5,197,726 A 3/1993 Nogami
5,253,862 A 10/1993 Acquaviva et al.
5,277,415 A 1/1994 Kinoshita et al.
5,280,322 A 1/1994 Kono
5,294,969 A * 3/1994 Ito ..... 399/36
5,393,044 A 2/1995 Hagihara et al.
5,414,495 A 5/1995 DeVito et al.
5,423,527 A 6/1995 Tranquilla
5,465,955 A 11/1995 Krupica et al.
5,495,326 A 2/1996 Mikida
5,501,444 A 3/1996 Yukimachi et al.
5,507,478 A 4/1996 Nottingham et al.
5,580,046 A 12/1996 Beaufort et al.
5,601,283 A 2/1997 Pinckney
5,602,625 A 2/1997 Okamoto et al.
5,651,538 A 7/1997 Chung et al.
5,667,215 A 9/1997 Yoshino
5,692,741 A 12/1997 Nakamura et al.
5,826,135 A 10/1998 Lee
5,878,321 A 3/1999 Miyazaki et al.
5,970,274 A 10/1999 Rath
5,970,277 A 10/1999 Shigeta et al.
6,011,936 A 1/2000 Kaneko
6,076,821 A 6/2000 Embry et al.
RE37,007 E 1/2001 Gerlier
6,170,816 B1 1/2001 Gillmann et al.
6,173,952 B1 1/2001 Richards et al.
6,273,418 B1 8/2001 Fujikura et al.
6,330,424 B1 12/2001 Chapman et al.
6,375,180 B1 4/2002 Kawano et al.
6,381,422 B1 4/2002 Tanaka
6,382,618 B1 5/2002 Takada
6,385,406 B1 5/2002 Funamizu et al.
6,446,954 B1 9/2002 Lim et al.
6,519,443 B1 2/2003 Coriale et al.
6,533,268 B2 3/2003 Williams et al.
6,575,458 B2 6/2003 Williams et al.
6,578,844 B2 6/2003 Acquaviva et al.
6,647,215 B1 * 11/2003 Ogle et al. ..... 399/13
6,665,507 B1 * 12/2003 Hooper et al. ..... 399/110
2002/0009302 A1 1/2002 Kodama et al.
2004/0022557 A1 * 2/2004 Kudo ..... 399/167
2004/0165018 A1 * 8/2004 Kono et al. ..... 347/14
2005/0063718 A1 * 3/2005 Oki ..... 399/27

* cited by examiner

PACKAGING DETECTION AND REMOVAL FOR AN IMAGE FORMING DEVICE

BACKGROUND

The present invention relates generally to image-forming devices, and particularly to methods of detecting the presence of packaging materials within image-forming devices.

Manufacturers typically pre-install some of the components and supplies into image-forming devices prior to shipping and distributing their product. Reducing the overall size of the package allows the manufacturers to distribute a greater number of image-forming devices in a single shipment thus minimizing the overall shipping and distribution costs, which translate into lower consumer prices. However, reducing the package size in this manner also requires securing the pre-installed components and supplies to prevent damaging the image-forming devices during shipment.

To protect against damage, manufacturers generally insert packaging materials within the image-forming device. The packaging materials may comprise, for example, sheets of cardboard, ties, plastic, styrofoam, and the like, and substantially prevent movement of the components and supplies during shipment. When purchased, the consumer should remove each of these packaging materials before powering on the image-forming device. Failure to remove the packaging materials could result in damage to the image-forming device. Generally, instructions on removing the packaging materials from within the image-forming device are included with an installation guide that is shipped with the image-forming device. However, some customers fail to heed these instructions or forget to remove all of the packaging materials.

SUMMARY

The present invention relates to methods of detecting the presence of packaging materials within an image-forming device. In one embodiment, the image-forming device comprises a sensor that senses a location within the image-forming device. During initialization, the sensor may generate a signal to a controller to indicate whether packaging material is present at the sensed location. If the sensor detects packaging material at the location, the image-forming device displays message to a user. In one embodiment, for example, the message includes a graphical representation of the image-forming device such as an icon. The message may also graphically depict the location of the packaging material within the image-forming device by highlighting or shading an area on the icon associated with the sensed location. When the sensor detects that a user has removed the packaging material, the sensor may generate another signal to the controller to cause the image-forming device to complete the initialization procedure in preparation for image-forming operations.

During image-forming operations, the sensor may generate additional signals that indicate one or more characteristics of the image-forming operation at the location. In one embodiment, for example, the sensor generates a signal to indicate a paper jam at the location within the image-forming device. In another embodiment, the sensor generates a signal to indicate the presence of a media sheet at the location within the image-forming device.

DETAILED DESCRIPTION

The present invention is directed to detecting the presence of packaging materials within an image-forming device during an initialization procedure. When detected, one or more messages graphically indicate the location of the packaging materials within the image-forming device. Additional messages may instruct an operator on how to remove the packaging materials. In cases where multiple packaging materials are detected during initialization, the image-forming device may prioritize an order in which the user is to remove the packaging materials. Once removed, the image forming device completes the initialization procedure in preparation for image-forming operations.

Figure 1:
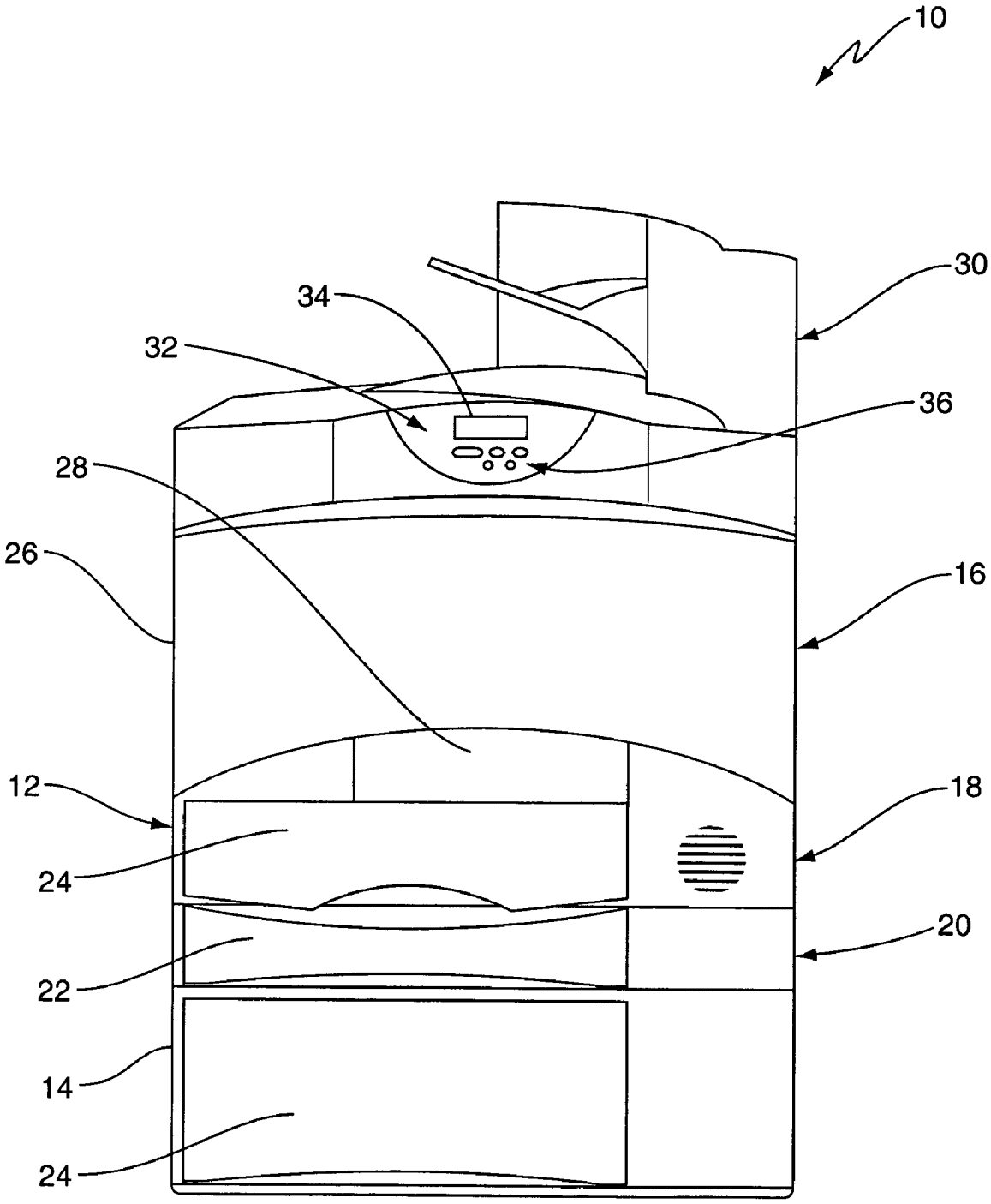
FIG. 1 is a side view of an image-forming device configured to operate according to one embodiment of the present invention.

Turning now to the drawings, an image-forming device configured according to one embodiment of the present invention is shown therein and indicated generally by the number 10. FIG. 1, for example, illustrates one embodiment of an exterior of the image-forming device 10 and various doors and drawers. Each of the doors and drawers are access points that provide access to different sections of the interior of image-forming device 10. The access points include an upper left access door 12, a left access door 14, an upper right access door 16, a lower right access door 18, a duplexer right access door 20, a duplexer front access door 22, first and second media tray drawers 24, 26, a front access door 28, and an output expander or mailboxer door 30.

Image-forming device 10 also includes a control panel 32 having a display 34 and a user interface 36 that allows a user to interact with and control the operation of image-forming device 10. Suitable displays 34 include, but are not limited to, liquid crystal displays (LCD) and touch-screen displays. Display 34 allows a user to view information such as menus and menu items, error messages, images, and other information regarding the operation and/or status of image-forming device 10. User interface 36 typically comprises one or more controls such as buttons that allow the operator to navigate menus and otherwise interact with image-forming device 10.

According to one embodiment of the present invention, display 34 may indicate the location of packaging material within the image-forming device using one or more messages. The messages may include, for example, icons or other graphical representations that indicate and/or depict the location of packaging materials within of the image-forming device 10, and/or text messages. The text messages may include the location of the packaging material(s), and instructions describing how the operator might remove the packaging materials from within the image-forming device 10.

Figure 2:
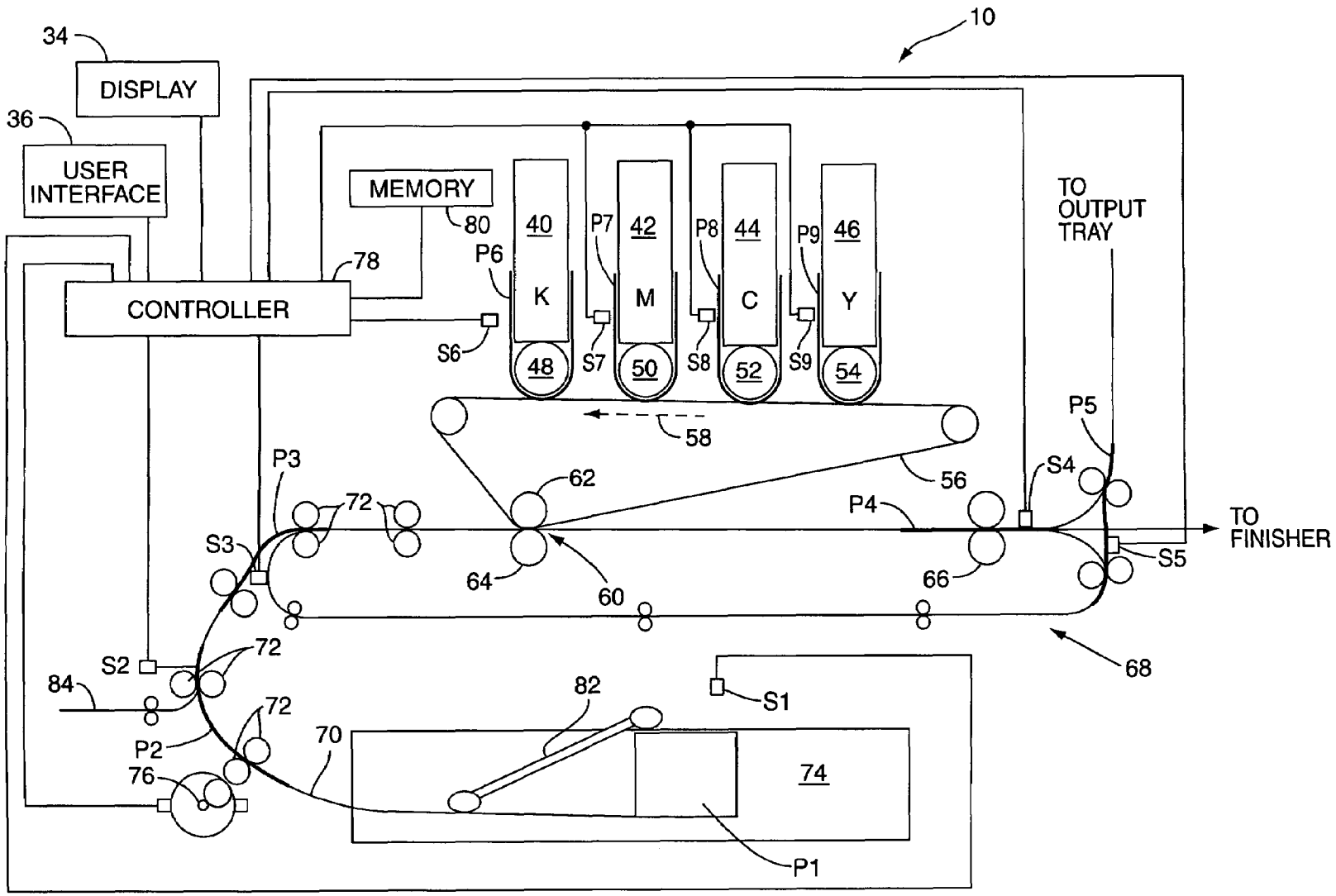
FIG. 2 is a partial schematic side view of the image-forming device configured to operate according to one embodiment of the present invention.

FIG. 2 illustrates a portion of the interior of image-forming device 10. As seen in FIG. 2, a plurality of toner cartridges 40, 42, 44, 46, each have a corresponding photoconductive (PC) drum 48, 50, 52, 54. Each toner cartridge has a similar construction but is distinguished by the toner color contained therein. In one embodiment, the image-forming device 10 includes a black cartridge 40, a magenta cartridge 42, a cyan cartridge 44, and a yellow cartridge 46. The different color toners form individual images in their respective color that are combined in a layered fashion to create the final multi-colored image.

Each PC drum 48, 50, 52, 54 has a smooth surface that receives an electrostatic charge from a laser assembly (not shown) within the image-forming device 10. Particularly, PC drums 48, 50, 52, 54 continuously rotate at a uniform speed. The laser assembly directs a laser beam onto selected portions of the surfaces of the PC drums 48, 50, 52, 54 to form an electrostatic latent image on each drum. The electrostatic latent images represent the image to be printed.

After receiving the latent image, each PC drum 48, 50, 52, 54 rotates past its respective toner cartridge 40, 42, 44, and 46 and receives toner. Particularly, each cartridge 40, 42, 44, 46 includes a toner bin that houses toner, and a developer roller for uniformly transferring toner to its respective PC drum 48, 50, 52, 54. A difference in the electrostatic potential attracts the toner from the developer rollers to the electrostatic latent image formed on the surfaces of each PC drum 48, 50, 52, 54.

An intermediate transfer medium (ITM) belt 56 then receives the toner images from each PC drum surface. As seen in FIG. 2, the ITM belt 56 is an endless belt that extends around a series of rollers adjacent to the PC drums 48, 50, 52, 54 as it moves in the direction indicated by arrow 58. The ITM belt 56 and the PC drums 48, 50, 52, 54 are synchronized to permit the toner images from each PC drum 48, 50, 52, 54 to precisely align with each other in an overlapping arrangement on the ITM belt 56. In one embodiment, a multi-color toner image is formed during a single pass of the ITM belt 56. By way of example, the yellow (Y) toner is placed first on the ITM belt 56, followed by the cyan (C) toner, the magenta (M) toner, and finally, the black (K) toner. In other embodiments, the ITM belt 56 may make a plurality of passes by the PC drums 48, 50, 52, 54 to form the overlapping toner image.

After receiving the toner images, the ITM belt 56 moves the toner image toward a transfer point 60 to transfer the toner images to a media sheet (not shown). A pair of rollers 62, 64 form a nip where the toner images are transferred from the ITM belt 56 to the media sheet. The media sheet with the toner image then travels through a fuser 66 where the toner is fused to the media sheet. The media sheet with the fused image is then either output to a finisher, exits from the image-forming device 10 to an output bin, or is routed through a duplexer 68 to form an image on a second side of the media sheet.

While the toner images are being formed and moved towards the transfer point 60, the media sheet are moved along a media path 70 to receive the image. As seen in FIG. 2, a series of spaced nip rollers 72 forms the media path 70. The media path 70 extends between the input tray 74, the transfer point 60, the fuser 66, the duplexer 68, and the finisher or exit. A motor 76 rotates the nip rollers 72 to control the speed and the position of each media sheet as it travels along the media path 70. Motor 76, in turn, is controlled by a controller 78 that generally controls the overall image-forming process. FIG. 2 illustrates one embodiment having a single motor 76 that controls the nip rollers 72 along the media path 70. However, those skilled in the art will readily appreciate that more than one motor may be positioned along the media path 70 to control the media sheets as needed or desired.

Controller 78 typically controls the timing of the toner image transfer and the media sheets, as well as the overall image-forming process. As seen in FIG. 2, controller 78 includes a microprocessor having associated memory 80. In one embodiment, the controller 78 also includes an input/output interface that communicatively connects the controller 78 with the various components of image-forming device 10. For example, controller 78 may interface with display 34 to display the graphic messages to the operator according to one embodiment of the present invention. Controller 78 may also interface with the user interface 36 to accept commands input by the user.

The media sheets are introduced into the media path 70 in a variety of different manners. In one method, for example, controller 78 controls a drive assembly (not shown) that activates a pick mechanism 82 to pick a top-most sheet from a stack of sheets stored in an input tray 74. Particularly, the pick mechanism 82 includes a rotating wheel or roller that moves the top-most media sheet from the input tray 74 into the media path 70. FIG. 2 illustrates the image-forming device 10 of the present invention as including only a single input tray 74. However, those skilled in the art will readily appreciate that image-forming device 10 may include a plurality of media input trays, each having a various capacity to hold media sheets of different types and sizes. A multi-purpose feeder 84 provides another method of introducing media sheets into the media path 70. With the multi-purpose feeder 84, the operator manually loads the media sheets into the multi-purpose feeder 84, while the rollers 72 move the sheet along the media path 70.

The image-forming device 10 also includes one or more sensors S1-S9 (referred to collectively as sensors), placed at predetermined locations within the image-forming device 10. Each sensor S1-S9 may be disposed to sense one or more locations within the image-forming device 10. In one embodiment, the sensors comprise optical sensors including an emitter and a receiver. The emitter may be, for example, a light-emitting diode, while the receiver may be a phototransistor. In another embodiment, the sensors may comprise mechanically-actuated sensors. For example, sensors S2-S5 may comprise an actuator arm positioned along the media path 70. During image-forming operations, a media sheet may push aside the actuator arm to actuate a switch as it moves along the media path 70. Actuation of the switch could generate an electrical signal that is sent to the controller 78. Regardless of their physical composition or structure, however, each sensor S1-S9 may perform a primary function during image-forming operations.

Typically, each of the sensors S1-S9 are communicatively connected to the controller 78, and perform a primary function during image-forming operations. For example, sensor S1 is placed proximate the media input tray 74, and may detect whether input tray 74 is installed in the image-forming device 10. Sensors S2-S5 may be disposed at predetermined locations along the media path 70 to detect leading and/or trailing edges of a media sheet as it travels along the media path 70. Sensors S6-S9 may be placed proximate a respective toner cartridge 40, 42, 44, 46 to detect whether the toner cartridges 40, 42, 44, 46 are installed in the image-forming device 10. Those skilled in the art will readily appreciate that the placements and numbers of sensors S1-S9 as shown in FIG. 2 are for illustrative purposes only. Image-forming device 10 may employ more or fewer sensors than are shown in the figures, and may further dispose those sensors at any location within image-forming device 10.

Generally, the primary functions of the sensors S1-S9 is to generate and send signals to the controller 78 during, and in support of, image-forming operations. The controller 78 receives the signals, interprets the signals, and performs some appropriate function. By way of example, sensor S1 may generate a signal to controller 78 responsive to detecting that the input tray 78 is not installed in the image-forming device 10. The controller 78, in turn, could display an error message for the user on display 34. Likewise, sensors S6-S9 may generate signals for controller 78 indicating that one or more of the toner cartridges 40, 42, 44, 46 are missing. Upon receiving the signals from the sensors S6-S9, controller 78 could display an appropriate error message for the operator. In a similar manner, sensors S2-S5 may generate signals indicative of a paper jam to the controller 78 as the media sheets move along the media path 70 during image forming operations.

In addition to these primary functions, however, one or more of the sensors S1-S9 may also perform secondary functions before the image-forming device 10 is prepared to perform image-forming operations. Particularly, during initialization of the image-forming device 10, one or more of the sensors S1-S9 may detect the presence or absence of packaging materials at certain locations within the image-forming device 10. Signals indicating the presence or absence of packaging materials are sent to the controller 78. If the signals from any of the sensors S1-S9 indicate the presence of packaging materials, controller 78 may display one or more messages to alert the operator to the presence of packaging materials. As seen in more detail below, the messages may depict the locations of the packaging materials within the image-forming device 10.

FIG. 2 illustrates packaging materials P1-P9 disposed at various locations within the image-forming device. Typically, the manufacturer inserts these packaging materials P1-P9 into the image-forming device 10 prior to shipping or distributing the image-forming device 10. The packaging materials P1-P9 secure the various components and supplies installed within the image-forming device 10 to prevent damage during shipment.

The packaging materials P1-P9 may comprise any packaging material known in the art. Packaging material P1, for example, comprises a multi-sided box-shaped structure that fits into the input tray 74. Packaging materials P2-P5 comprise semi-rigid sheets of cardboard or paper disposed at various locations along the media path 70. Packaging materials P6-P9 are "u-shaped" sheets of semi-rigid cardboard disposed around the photoconductive drums 48, 50, 52, 54 and a portion of their corresponding toner cartridges 40, 42, 44, 46. Other types of materials, such as ties and styrofoam, may be employed in addition to or in lieu of the packaging materials P1-P9 shown in FIG. 2.

Each sensor S1-S9 may be oriented at a location within the image-forming device 10 such that they detect their respective packaging materials P1-P9. During initialization or start-up of the image-forming device 10, one or more of the sensors S1-S9 may generate a signal to controller 78. The signals indicate whether any of the sensors S1-S9 detected a packaging material P1-P9 at a corresponding location. Controller 78 interprets these signals received from the sensors and either displays a message for the operator to alert the operator to the presence of packaging materials P1-P9, or, if no packaging materials P1-P9 are present within the image-forming device 10, continues to initialize the image-forming device 10 in preparation for image-forming operations.

In one embodiment, for example, memory 80 stores the locations of each of the sensors S1-S9. Each location may be associated with various data and information according to the present invention. For example, each location may be associated with data defining one or more access points where the user can gain access to the location within the image-forming device 10. In addition, each location may also be associated with a set of instructions describing how to remove a given packaging material P1-P9 from the location. Other information that may be associated with the locations stored in memory 80 are one or more graphical depictions or representations of the image-forming device 10, and of the locations of the packaging materials P1-P9.

Upon initialization, the controller 78 may read the information from memory 80 upon receiving one or more of these signals to determine the location of the sensors generating the signals, and thus, the location of corresponding packaging materials. Additionally, the controller might also obtain the access point associated with the locations, and the instructions on how to remove the packaging material from the particular location. Controller 78 may then use this information to generate a message for display to the operator.

Figure 3A:
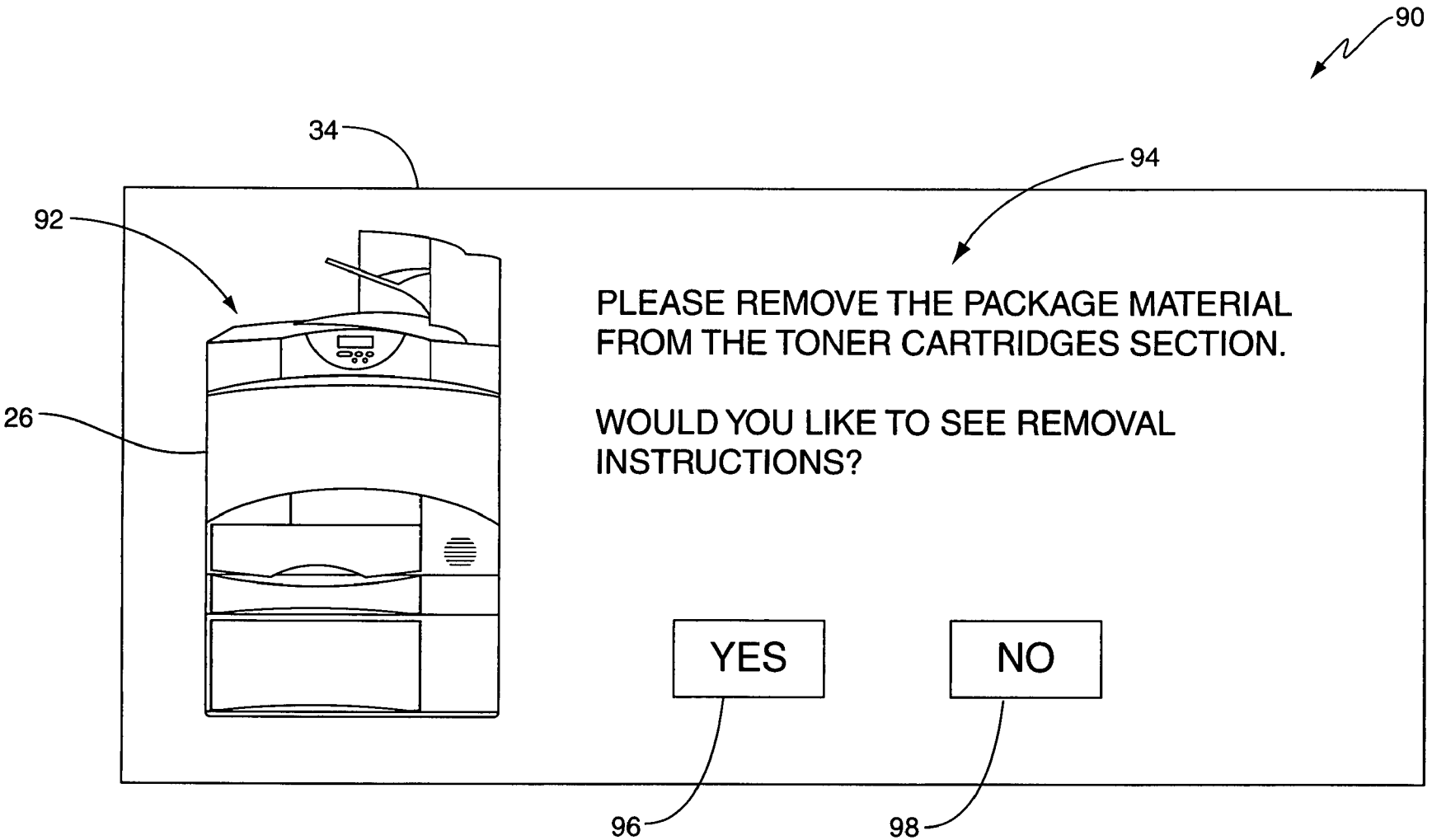
FIG. 3A illustrates a display that graphically indicates the presence and location of packaging materials within the image-forming device according to one embodiment of the present invention.

FIG. 3A, for example, illustrates one embodiment of a message 90 generated by controller 78 for display on display 34. Message 90 includes a graphical representation 92 of image-forming device 10 and an alphanumeric portion 94. In this embodiment, the message 90 indicates the location of the packaging material within the image-forming device 10 by highlighting a particular access point on the exterior of the image-forming device 10. Message 90 also textually describes the location of the detected packaging materials in alphanumeric section 94. In this example, message 90 indicates that packaging material remains in the area of the toner cartridges section by highlighting the second media tray drawer on graphical representation 92, and by textually describing the location in alphanumeric section 94. In one embodiment (not illustrated), message 90 is a graphical representation of the image forming device 10. In another embodiment (not illustrated), message is an alphanumeric message.

Message 90 may also present the user with an option to view removal instructions specific to the packaging material left in the toner cartridges section. In FIG. 3A, display 34 is a touch-sensitive display screen. Thus, the operator may touch either of control buttons 96 ("YES") or 98 ("NO") to display or not display the removal instructions. Alternatively, the user may actuate one or more control buttons located on user interface 36 to cause controller 78 to display the removal instructions.

Figure 3B:
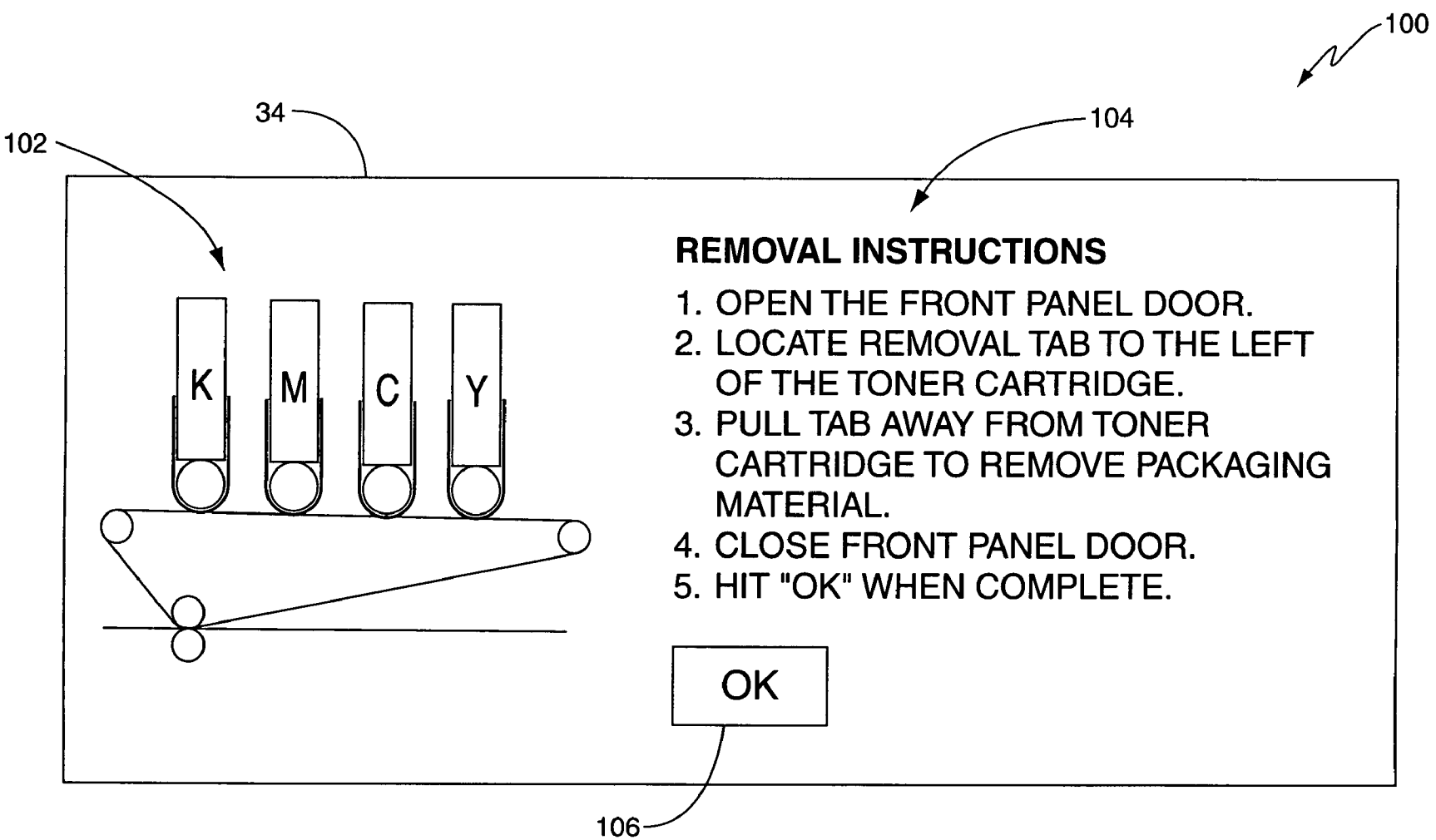
FIG. 3B illustrates the display graphically indicating instructions on how to remove the packaging materials from within the image-forming device according to one embodiment of the present invention.

FIG. 3B illustrates one example of another message 100 that may be invoked when the operator touches the control button 96 ("YES") on message 90. Similar to message 90, message 100 includes a graphical representation 102 of a portion of the interior of the image-forming device 10, and a set of textual removal instructions 104 that describe how to remove the packaging material from the location shown by graphical representation 102. In this example, the sensors S6-S9 have each detected the presence of packaging materials P6-P9 at locations proximate the toner cartridges 40, 42, 44, and 46, and PC drums 48, 50, 52, and 54. The graphical representation 102 illustrates this portion of the interior of the image-forming device 10, as well as instructions for removing the packaging materials from this location. The operator follows the instructions, and then touches a control button 106 to indicate when the packaging materials have been removed.

In some embodiments, the display 34 does not display control buttons. Rather, the image-forming device 10 may include one or more switches (not shown) communicatively connected to the various access points. These switches may generate signals to the controller 78 to indicate when the operator opens and closes the access points. Controller 78 could use these signals to presume that the operator has removed the packaging materials.

It should be noted that, according to the present invention, the controller 78 may suspend the initialization procedure upon the detection of the presence of packaging materials. Further, controller 78 might not continue the initialization procedure until all packaging materials have been removed from within the interior of the image-forming device 10.

Figure 3C:
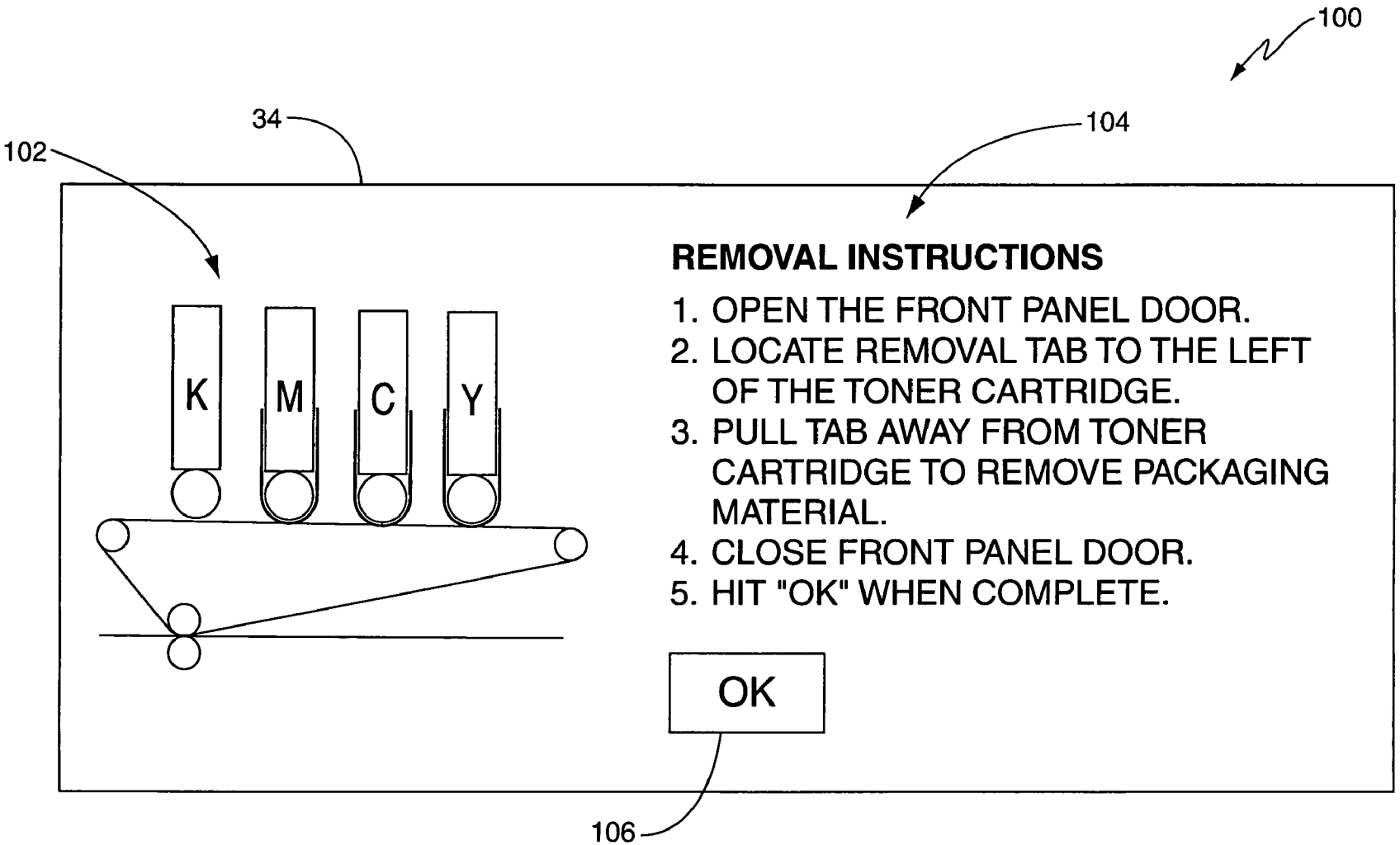
FIG. 3C illustrates the display graphically indicating instructions on how to remove additional packaging materials from within the image-forming device according to an alternate embodiment of the present invention.

As seen in FIG. 3C, for example, an operator has removed packaging material P6 from the location associated with the black toner cartridge 40 and corresponding PC drum 48. However, packaging materials P7-P9 remain within the image-forming device 10. The controller 78 is configured to determine whether all packaging materials have been removed from the image-forming device 10, and generate additional messages 90 and/or 100 based on that determination.

In one embodiment, controller 78 might control one or more of the sensors S1-S9 to re-sense their respective locations. Based upon any received signals, controller 78 might update the message with graphical representations 102 and/or any associated removal instructions 104 for the remaining packaging materials. In other embodiments, controller 78 might maintain a count variable in memory 80 that indicates the number of packaging materials initially detected. As the operator removes the packaging materials, controller 78 could decrement the count.

In the embodiment of FIG. 3C, sensors S7-S9 have detected that packaging materials P7-P9 remain within the corresponding locations. Sensors S7-S9 then generate additional signals to controller 78, which then updates display 34 to show that packaging materials P7-P9 remain within the image-forming device. This process—detection, removal, and re-detection—may continue until all packaging materials have been removed from within the image-forming device 10. At each iteration, controller 78 will update display 34 to accurately depict the location of the remaining packaging materials within the image-forming device 10.

In cases where multiple packaging materials are detected within the image-forming device 10, controller 78 may prioritize an order in which the user should remove the packaging materials. Controller 78 may prioritize removal, for example, according to a "least disruptive" method. Least disruptive is defined as the manner of removing the packaging materials from within the image-forming device 10 that will be the least likely to cause damage to the device, or require the least amount of operator intervention. Consider, for example, two packaging materials P4, P5 detected by sensors S4, S5, respectively. A user may not be able to easily remove packaging material P4 without first removing packaging material P5. In this case, controller 78 would prioritize the order of removal of packaging materials P4, P5 such that the operator removes packaging material P5 prior to removing packaging material P4. The controller 78 could enforce prioritization by displaying messages 90 and/or 100 according to the determined order of removal. That is, controller 78 might delay displaying a message 90, 100 specific to the removal of packaging material P4 until it receives a signal from sensor S5 that indicates that packaging material P5 is no longer present within the image-forming device 10.

Data specifying the priority in which packaging materials are to be removed may be also stored in memory 80. In one embodiment, for example, each location stored in memory 80 is also associated with a number. Controller 78 could compare the numbers for each location at which a packaging material exists, and base a prioritization of removal on that comparison. It should be noted, however, that the present invention is not limited to the aforementioned priority scheme. For example, each sensor within the image-forming device might be configured to provide a signal to controller having a specified signal strength. Controller 78 could compare the relative strengths of signals received from two or more sensors, determine the locations of the sensors based on the signal strengths, and prioritize removal accordingly. Other priority schemes may also be used to determine a removal priority for packaging materials within the image-forming device 10.

Figure 4:
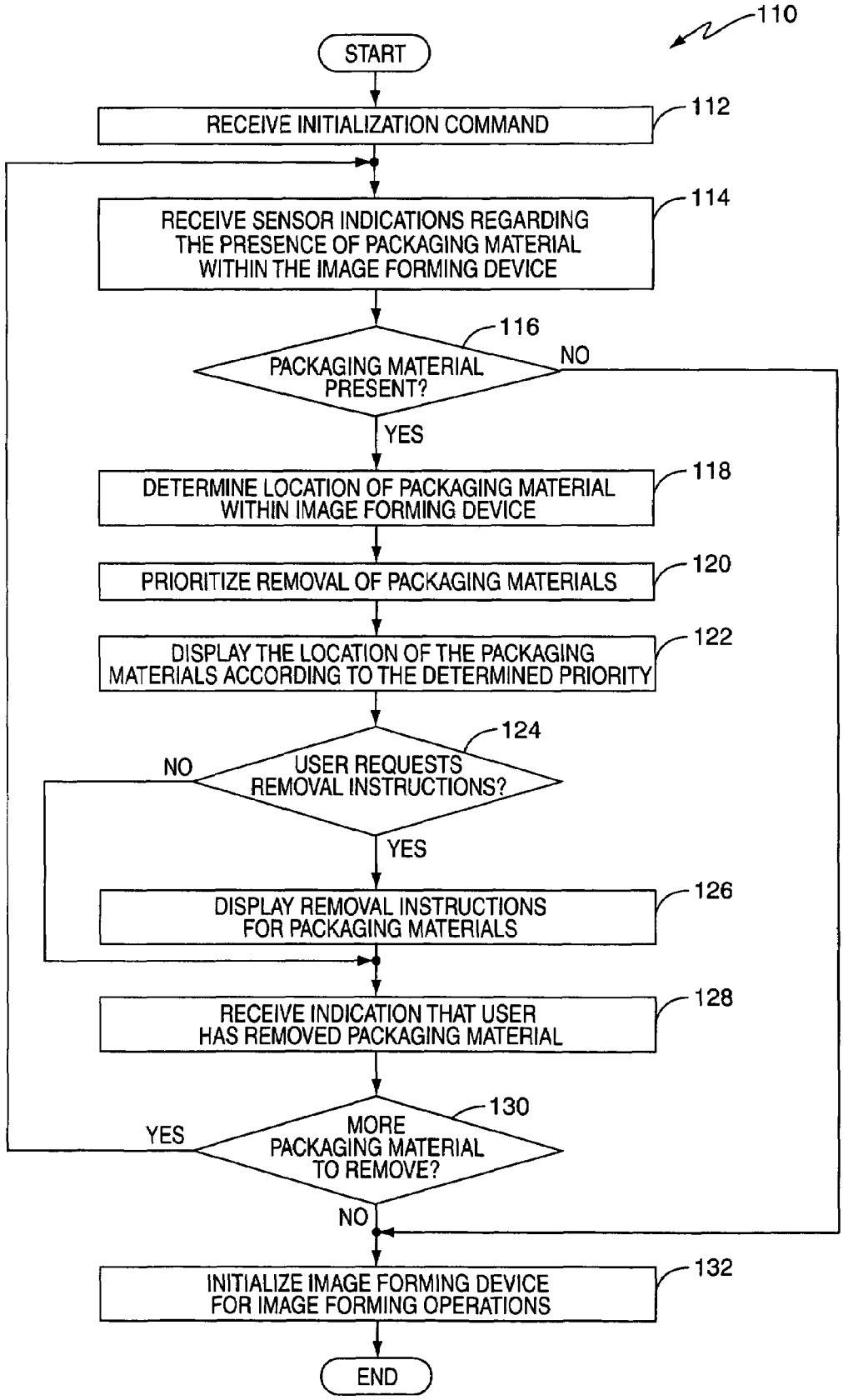
FIG. 4 is a flow chart diagram of one method of practicing an embodiment of the present invention.

FIG. 4 illustrates one method of practicing an embodiment of the present invention. The method 110 begins when controller 78 receives an initialization command from the user (box 112). The initialization command may be generated, for example, when the user powers up the image-forming device 10. During the initialization process, controller 78 receives indications from the sensors S1-S9 regarding the presence of packaging materials within image-forming device 10 (box 114). If any of the sensors S1-S9 indicate that packaging material is present within the image-forming device 10 (box 116), controller 78 determines the location of the packaging materials (box 118). In cases where two or more sensors indicate the presence of packaging materials, controller 78 may prioritize an order of removal of the packaging materials (box 120). Controller 78 then generates control signals to display the location of the packaging materials according to the determined priority (box 122).

If the user requests instructions on how to remove the packaging materials (box 124), the controller 78 may reference the information stored in memory 80 and display the removal instructions for the identified packaging materials (box 126). Controller 78 may receive an indication once the operator has removed some or all of the identified packaging materials (box 128). Upon receiving the indication, controller 78 will determine whether additional packaging materials remain within the image-forming device 10 (box 130). If packaging materials remain within the image-forming device 10, controller 78 displays a message 90 specific to the location of the packaging material. Otherwise, once all packaging materials have been removed from the image-forming device 10, the controller 78 continues the initialization procedure to prepare for image-forming operations (box 132).

The present invention may be carried out in other ways than those specifically set forth herein without departing from essential characteristics of the invention. In one embodiment, the first and second sensors are combined into a single sensor. The present embodiments are to be considered in all respects as illustrative and not restrictive, and all changes coming within the meaning and equivalency range of the appended claims are intended to be embraced therein.

What is claimed is:

1. A method of initializing an image-forming device, the method comprising:

receiving an initialization command;

receiving signals from first and second sensors located at different positions along a media path and within the image forming device away from the media path, the first sensor indicating the presence of packaging material at an input tray and the second sensor indicating the presence of packaging material at a toner cartridge;

displaying the location of the packaging material responsive to receiving the signals;

displaying a message to remove the packaging material;

determining that the packaging material has been removed from the location within the image-forming device;

initializing the image-forming device in preparation to form an image on a media sheet;

receiving an indication from the first sensor first that the input tray is within the image-forming device and that a media sheet is moving along the media path at the input tray; and receiving a second indication from the second sensor that the toner cartridge is within the image-forming device and the media sheet is moving along the media path at the toner cartridge.

2. The method of claim 1 wherein displaying the location of the packaging material comprises displaying a graphical representation of a portion of the image-forming device to a user, the graphical representation graphically indicating an access point associated with the location of the packaging material within the image-forming device.

3. The method of claim 1 wherein displaying the location of the packaging material comprises displaying alphanumeric text describing the location of the packaging material within the image-forming device.

4. The method of claim 1 further comprising displaying instructions that describe how to remove the packaging material from within the image-forming device.

5. The method of claim 4 wherein displaying instructions that describe how to remove the packaging material from within the image-forming device comprises displaying a graphical representation that indicates the location of the packaging within the image-forming device.

6. The method of claim 5 wherein displaying instructions that describe how to remove the packaging material from within the image-forming device further comprises displaying text describing one or more steps a user should perform to remove the packaging material within the image-forming device.

7. The method of claim 1 wherein determining that the packaging material has been removed from the location within the image-forming device comprises determining that the packaging material has been removed responsive to receiving a second signal from the sensor.

8. A method of initializing an image-forming device, the method comprising:

sensing an input tray at a first location along a media path within the image-forming device with a first sensor;

sensing a toner cartridge at a second location spaced away from the media path within the image-forming device with a second sensor;

displaying a first message indicating the presence of a first packaging material at the first location responsive to a first signal received from the first sensor;

displaying a second message indicating the presence of a second packaging material at the second location responsive to a second signal received from the second sensor, the second message being different from the first message;

determining whether the first and second packaging materials have been removed from the first and second locations;

initializing the image-forming device in preparation to form an image on a media sheet when the first and second packaging materials have been removed from the first and second locations, respectively;

after the step of initializing, sensing a media sheet at the first location along the media path by the first sensor and along the media path at the toner cartridge by the second sensor.

9. The method of claim 8 wherein determining whether the first and second packaging materials have been removed from the first and second locations comprises:

re-sensing the first location with the first sensor; and determining that the first packaging material has been removed responsive to receiving a third signal from the first sensor.

10. The method of claim 9 wherein determining whether the first and second packaging materials have been removed from the first and second locations further comprises:

re-sensing the second location with the second sensor; and determining that the second packaging material has been removed responsive to receiving a fourth signal from the second sensor.

11. The method of claim 9 wherein determining whether the first and second packaging materials have been removed from the first and second locations further comprises:

re-sensing the second location with the second sensor;

determining that the second packaging material remains at the second location responsive to re-receiving the second signal; and displaying the second message to indicate that the second packaging material remains at the second location responsive to re-receiving the second signal.

12. The method of claim 8 further comprising receiving a third signal from the first sensor and a fourth signal from the second sensor after the image-forming device has been initialized.

13. The method of claim 12 further comprising receiving fifth and sixth signals from the first and second sensor during an image-forming operation.

14. The method of claim 8 further comprising:

determining that the first packaging material should be removed prior to the second packaging material;

displaying the first message; and delaying the display of the second message until determining that the first packaging material has been removed.

15. The method of claim 8 wherein the first and second sensors comprise a single sensor.

16. A method of initializing an image-forming device, the method comprising:

sensing a first packaging material at a first location within the image-forming device with a first sensor;

sensing a second packaging material at a second location within the image-forming device with a second sensor, the second location being different from the first location;

prioritizing an order in which a user should remove the first and second packaging materials by determining that the first packaging material should be removed prior to the second packaging material based on a comparison of a first signal strength received from the first sensor and a second signal strength received from the second sensor;

displaying a message to the user to remove the packaging materials according to the prioritization of removal;

sensing a first component at the first location and a first media sheet at the first location with the first sensor; and sensing a second component at the second location and a second media sheet at the second location with the second sensor.

17. The method of claim 16 wherein prioritizing an order in which a user should remove the first and second packaging materials comprises:

identifying the first and second locations within the image-forming device based on first and second signals received from the first and second sensors, respectively; and determining that the first packaging material should be removed prior to the second packaging material based on a comparison of the first and second locations to predefined prioritization data stored in a memory.

18. The method of claim 16 wherein displaying a message to the user to remove the packaging materials according to the prioritization of removal comprises:

displaying a first message to indicate that the first packaging material should be removed from the first location, the first message including a graphical representation of at least a portion of the image-forming device to graphically indicate access to the first location to a user;

displaying a second message to indicate that the second packaging material should be removed from the second location, the second message being different than the first message and including a graphical representation of at least a portion of the image-forming device to graphically indicate access to the second location to the user; and delaying the display of the second message until after the first packaging material has been removed from the first location.

19. The method of claim 18 further comprising:

displaying, with the first message, first instructions on how to remove the first packaging materials from the first location, the first instructions including a graphical representation of the first location within the image-forming device; and displaying, with the second message, second instructions on how to remove the second packaging materials from the second location, the second instructions including a graphical representation of the second location within the image-forming device.

* * * * *